US009108329B2

(12) United States Patent
Stiles

(10) Patent No.: US 9,108,329 B2
(45) Date of Patent: Aug. 18, 2015

(54) PERSONAL STYLING RAZOR

(76) Inventor: Sharidan L. Stiles, Redding, CA (US)

( * ) Notice: Subject to any disclaimer, the term of this patent is extended or adjusted under 35 U.S.C. 154(b) by 740 days.

(21) Appl. No.: 11/775,688

(22) Filed: Jul. 10, 2007

(65) Prior Publication Data

US 2008/0040936 A1 Feb. 21, 2008

Related U.S. Application Data

(63) Continuation-in-part of application No. 10/648,686, filed on Aug. 25, 2003, which is a continuation-in-part of application No. 10/219,095, filed on Aug. 13, 2002, which is a continuation of application No. 09/725,789, filed on Nov. 29, 2000, now abandoned.

(60) Provisional application No. 60/830,952, filed on Jul. 14, 2006, provisional application No. 60/245,397, filed on Nov. 1, 2000.

(51) Int. Cl.

| | |
|---|---|
| ***B26B 21/14*** | (2006.01) |
| ***B26B 21/40*** | (2006.01) |
| ***B26B 21/06*** | (2006.01) |
| ***B26B 21/16*** | (2006.01) |
| ***B26B 21/52*** | (2006.01) |
| ***B26B 21/22*** | (2006.01) |

(52) U.S. Cl.

CPC ..... *B26B 21/4031* (2013.01); *B26B 21/06* (2013.01); *B26B 21/14* (2013.01); *B26B 21/16* (2013.01); *B26B 21/22* (2013.01); *B26B 21/4012* (2013.01); *B26B 21/4018* (2013.01); *B26B 21/521* (2013.01); *B26B 21/522* (2013.01); *B26B 21/523* (2013.01)

(58) Field of Classification Search

CPC ..... B26B 21/00; B26B 21/04; B26B 21/06; B26B 21/14; B26B 21/16; B26B 21/165; B26B 21/40; B26B 21/4012; B26B 21/4018; B26B 21/4031; B26B 21/52; B26B 21/521; B26B 21/522; B26B 21/525; B26B 21/54; B26B 21/56; B26B 21/565

USPC ..... 30/32, 34.1, 41, 48, 50, 51, 84, 526, 30/532, 535; D28/44, 44.1, 45–48; 132/214–216, 148, 289

See application file for complete search history.

(56) References Cited

U.S. PATENT DOCUMENTS 843,148 A 2/1907 Jackson
855,608 A 6/1907 Ballreich (Continued)

FOREIGN PATENT DOCUMENTS

DE 3136033 A1 * 3/1983 ..... B26B 21/52

OTHER PUBLICATIONS

DE 3136033 A1 translation.*

(Continued)

*Primary Examiner* — Jason Daniel Prone

(74) *Attorney, Agent, or Firm* — Knobbe Martens Olson & Bear LLP

(57) ABSTRACT

A hand-held razor has single or multiple blades of a smaller dimension than is typical and features an ergonomically advantageous handle allow more detailed shaving and hair removal. The increased detail allows shaving of more difficult areas for shaving and allows detailed hair removal for fashionable shaving styles of the beard, goatee, scalp, sideburns or other areas. Embodiments include a shaving head that is an integrated disposable razor or is part of a replaceable razor blade cartridge.

14 Claims, 7 Drawing Sheets

(56) References Cited

U.S. PATENT DOCUMENTS

| | | | | | |
|---|---|---|---|---|---|
| 890,406 | A | | 6/1908 | Cobb et al. | |
| 915,989 | A | | 3/1909 | Moore | |
| 1,558,021 | A | * | 10/1925 | Libi | 30/32 |
| 2,139,680 | A | | 12/1938 | Heinrich et al. | |
| 2,169,680 | A | | 12/1938 | Heinrich et al. | |
| 2,127,010 | A | | 8/1939 | Sampson et al. | |
| 2,367,571 | A | | 1/1945 | Gaide et al. | |
| D142,175 | S | | 8/1945 | Shipley et al. | |
| 2,517,028 | A | | 8/1950 | Ridner et al. | |
| 2,547,376 | A | * | 4/1951 | Crawford | 30/32 |
| D169,147 | S | | 3/1953 | Lamb et al. | |
| 2,645,009 | A | | 7/1953 | Cohen | |
| 2,737,714 | A | * | 3/1956 | O'Gatty | 30/32 |
| 2,743,732 | A | | 5/1956 | Lovasz et al. | |
| 2,930,120 | A | | 3/1960 | Sherosky | |
| 3,111,757 | A | | 11/1963 | Dubofsky et al. | |
| 3,178,814 | A | | 4/1965 | Stoudenmire et al. | |
| D217,752 | S | * | 6/1970 | Barry et al. | D28/46 |
| 3,626,591 | A | * | 12/1971 | Robey | D28/46 |
| 3,703,765 | A | * | 11/1972 | Perez | 30/41 |
| D230,219 | S | | 1/1974 | Glaberson et al. | |
| 4,031,620 | A | * | 6/1977 | Pomfret | 30/346.57 |
| 4,128,937 | A | | 12/1978 | Adorney | |
| D254,692 | S | | 4/1980 | Del Re | |
| D259,743 | S | | 6/1981 | Hollinger et al. | |
| 4,283,808 | A | | 8/1981 | Beebe | |
| 4,285,124 | A | | 8/1981 | Diakonov et al. | |
| 4,335,509 | A | | 6/1982 | Smith et al. | |
| 4,461,078 | A | | 7/1984 | Carreker | |
| 4,514,903 | A | | 5/1985 | Pope | |
| 4,523,781 | A | | 6/1985 | Brody | |
| D279,930 | S | | 7/1985 | George | |
| 4,700,477 | A | * | 10/1987 | Heller | 30/51 |
| 4,719,063 | A | | 1/1988 | White | |
| 4,785,534 | A | | 11/1988 | Lazarchik et al. | |
| 4,845,845 | A | * | 7/1989 | Scott | 30/32 |
| D302,739 | S | * | 8/1989 | Beuchat | D28/48 |
| D302,869 | S | * | 8/1989 | Beuchat | D28/46 |
| 4,903,405 | A | | 2/1990 | Halevy et al. | |
| D310,271 | S | | 8/1990 | Jacobson | |
| 4,961,262 | A | | 10/1990 | Lawrence et al. | |
| 4,989,328 | A | | 2/1991 | Sokoloff et al. | |
| 5,031,319 | A | | 7/1991 | Althous et al. | |
| 5,113,586 | A | | 5/1992 | Lazarchik et al. | |
| 5,269,062 | A | | 12/1993 | Dallaire et al. | |
| 5,333,382 | A | | 8/1994 | Buchbinder | |
| 5,343,622 | A | | 9/1994 | Andrews et al. | |
| D354,371 | S | | 1/1995 | Wood | |
| D354,586 | S | | 1/1995 | Grange et al. | |
| 5,469,621 | A | | 11/1995 | Alsept et al. | |
| 5,497,551 | A | | 3/1996 | Apprille et al. | |
| D370,742 | S | | 6/1996 | Chase | |
| D371,221 | S | * | 6/1996 | Attaway | D28/46 |
| 5,673,711 | A | | 10/1997 | Andrews et al. | |
| D386,820 | S | | 11/1997 | Morrissette et al. | |
| 5,778,535 | A | | 7/1998 | Ledesma et al. | |
| 5,921,775 | A | | 7/1999 | Buchanan | |
| 5,933,959 | A | | 8/1999 | Sferruzza et al. | |
| D415,316 | S | | 10/1999 | Prochaska et al. | |
| 6,049,936 | A | | 4/2000 | Holley | |
| 6,052,905 | A | | 4/2000 | Branchinelli et al. | |
| 6,145,201 | A | | 11/2000 | Andrews et al. | |
| 6,308,416 | B1 | | 10/2001 | Bosy et al. | |
| D454,413 | S | | 3/2002 | Shepperson et al. | |
| 6,473,971 | B2 | * | 11/2002 | Ordaz | 30/32 |
| 6,530,151 | B2 | | 3/2003 | Kameka et al. | |
| 6,598,303 | B2 | | 7/2003 | Bosy et al. | |
| 6,691,415 | B2 | * | 2/2004 | Quals | 30/32 |
| D500,172 | S | * | 12/2004 | Fields | D28/46 |
| 6,928,738 | B2 | * | 8/2005 | Segrea | 30/535 |
| D524,481 | S | | 7/2006 | Allen, Sr. | |
| D542,468 | S | * | 5/2007 | Stiles | D28/46 |
| 2002/0062568 | A1 | * | 5/2002 | Stiles | 30/526 |
| 2002/0083600 | A1 | | 7/2002 | Donovan | |
| 2002/0157258 | A1 | * | 10/2002 | Curran | 30/50 |
| 2002/0189104 | A1 | * | 12/2002 | Stiles | 30/50 |
| 2003/0019078 | A1 | | 1/2003 | Lauer et al. | |
| 2003/0024543 | A1 | * | 2/2003 | Wolf | 30/194 |
| 2003/0208914 | A1 | | 11/2003 | Ehrlich et al. | |
| 2004/0035003 | A1 | * | 2/2004 | Stiles | 30/50 |
| 2004/0055159 | A1 | | 3/2004 | Khomari et al. | |
| 2004/0123467 | A1 | | 7/2004 | Policappelli et al. | |
| 2005/0022386 | A1 | | 2/2005 | Macove et al. | |
| 2005/0028372 | A1 | | 2/2005 | Brown et al. | |
| 2006/0123640 | A1 | * | 6/2006 | Stiles | 30/526 |

OTHER PUBLICATIONS

Office Action dated Dec. 7, 2001 in U.S. Appl. No. 09/725,789.
Office Action dated May 13, 2002 in U.S. Appl. No. 09/725,789.
Office Action dated Jan. 21, 2003 in U.S. Appl. No. 10/219,095.
Office Action dated Mar. 26, 2004 in U.S. Appl. No. 10/219,095.
Office Action dated Feb. 28, 2005 in U.S. Appl. No. 10/648,686.
Office Action dated Aug. 25, 2005 in U.S. Appl. No. 10/648,686.
Office Action dated Jun. 26, 2006 in U.S. Appl. No. 10/648,686.
Office Action dated Jun. 26, 2006 in U.S. Appl. No. 11/352,589.
Office Action dated Dec. 11, 2006 in U.S. Appl. No. 10/648,686.
Office Action dated Dec. 15, 2006 in U.S. Appl. No. 10/219,095.
Office Action dated May 31, 2007 in U.S. Appl. No. 10/219,095.
Office Action dated Apr. 18, 2007 in U.S. Appl. No. 10/648,686.
Office Action dated Oct. 3, 2007 in U.S. Appl. No. 10/648,686.

* cited by examiner

PERSONAL STYLING RAZOR

CROSS-REFERENCE TO RELATED APPLICATIONS

The present application claims the benefit under 35 USC §119(e) of U.S. Provisional Application No. 60/830952, filed Jul. 14, 2006; the present application is a continuation-in-part of U.S. application Ser. No. 10/648,686, filed Aug. 25, 2003, which is a continuation-in-part of U.S. application Ser. No. 10/219,095, filed Aug. 13, 2002, which is a continuation of U.S. application Ser. No. 09/725,789, filed Nov. 29, 2000, now abandoned, which claims the benefit under 35 USC §119(e) of U.S. Provisional Application No. 60/245,397, filed Nov. 1, 2000.

BACKGROUND OF THE INVENTION

1. Field of the Invention

The present invention relates to personal shaving razors and particularly disposable and replaceable razors for grooming in fine detail.

2. Description of the Related Art

Current razors both disposable and replaceable head-type are typically suited to remove hair from the face or legs or head and are usually about an inch across in shaving width. Other previous razors are adapted for trimming, rather than shaving. There is a need for a razor with a reduced size head for shaving areas requiring much finer detail such as, for example, the eyebrows, the bikini area, and around the nose and ears. There is also a need for such a razor for shaving fine details and shapes into the hair on a person's scalp, such as is popular among some cultures. What is needed is a razor capable of shaving in much finer detail.

SUMMARY OF THE INVENTION

The systems and methods have several features, no single one of which is solely responsible for its desirable attributes. Without limiting the scope as expressed by the claims that follow, its more prominent features will now be discussed briefly. After considering this discussion, and particularly after reading the section entitled "Detailed Description of the Preferred Embodiments" one will understand how the features of the system and methods provide several advantages over traditional systems and methods.

One aspect is a personal styling razor, comprising a handle portion having lower, middle and upper longitudinal portions and a head portion having a razor blade integrally attached to the head portion. In one embodiment, the lower longitudinal portion extends along a first axis and the upper longitudinal portion extends along a second axis and the first and second axes form a control angle that is less than ninety degrees and the razor blade has a width of less than or equal to one inch.

In another aspect, the head portion is replaceable. In some embodiments, the head portion is pivotally mounted on the handle portion. The personal styling razor of some embodiments has a control angle of greater than ninety degrees.

In yet another aspect, the personal styling razor has a length of the upper longitudinal portion that is greater than the width of the blade.

In some aspects, the personal styling razor further comprises a second razor blade mounted substantially parallel to the razor blade.

In another aspect, the personal styling razor has a lower longitudinal portion that comprises a first curved shape and a middle longitudinal portion that comprises a second curved shape and wherein the first and second curved shapes form an ergonomically advantageous grip for the personal styling razor.

In yet another aspect, the personal styling razor further comprises a glide surface area and a blade area, wherein the glide surface area is larger than the blade area.

In another embodiment, the personal styling razor comprises a handle portion having lower and upper longitudinal portions, a head portion, having a razor blade with a straight cutting edge, attached to the upper longitudinal portion; where the cutting edge of the razor blade is substantially perpendicular to a longitudinal axis of the handle; where the lower longitudinal portion has a longitudinal axis and the upper longitudinal portion has a longitudinal axis, where the longitudinal axes of the upper and lower longitudinal portions form an angle that is about 135 degrees, where the head portion is less than or equal to ¼ inch wide, where the razor has an overall length of less than or equal to about 3.5 inches and where the lower longitudinal portion has a maximum diameter of less than or equal to about ¼ inch wide. In some embodiments, the head portion and handle portion, with the exception of the blade, are a single piece of molded plastic. In some embodiments, the personal styling razor further comprises a grip enhancing element on a portion of the lower longitudinal portion of the handle, where the grip enhancing element has a maximum diameter less than or equal to about ⅜ inch.

In a preferred embodiment, the personal shaving razor comprise a handle portion having an upper longitudinal portion and a lower longitudinal portion, where the lower longitudinal portion has a longitudinal axis and the upper longitudinal portion has a longitudinal axis and the longitudinal axes of the upper and lower longitudinal portions form an angle that is about 135 degrees, and the handle portion has a maximum width of less than or equal to about ¼ inch wide; a head portion attached to an end of the upper longitudinal portion of the handle such that the head portion is substantially normal to the longitudinal axis of the upper longitudinal portion of the handle, the head portion having a razor blade with a straight cutting edge that is substantially perpendicular to a longitudinal axis of the handle; where the head portion and blade are less than or equal to about ¼ inch wide; where the razor has an overall length of less than or equal to about 3.5 inch; and where the cutting edge of the blade extends beyond the head portion about 0.02 inch such that no portion of the razor extends beyond the cutting edge of the blade, and the cutting edge of the blade is unobstructed by any portion of the razor, such that the cutting edge can shave unwanted hair from a body surface by cutting the hair close to the root.

DETAILED DESCRIPTION OF EMBODIMENTS OF THE INVENTION

Figure 1:
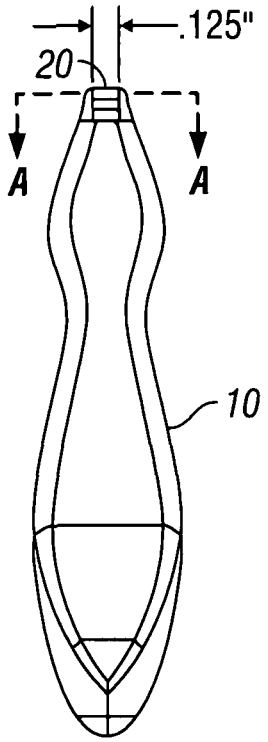
FIG. 1 is a front perspective view of an embodiment of a razor.

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Embodiments of the present invention relate to a styling and grooming razor used for removing unwanted body hair in hard-to-reach or awkward places. Additionally, the razor of these embodiments can be used for shaving with a high degree of detail for safety and ornamental shaving. For example, the razor could be used to groom the eyebrows, moustache, nose, sideburns, scalp, abdomen, bikini area, toes and other parts of the body. Unlike prior razors, the present razors are specifically designed to enable the user to shave unwanted hair close to the skin with great precision and detail. Previous small razors were designed only to permit trimming of hair from orifices such as the nose or ear, or had other design features which prohibited their use to precisely shave by cutting unwanted hair close to the root or at the surface of the skin—this the difference between "shaving" and "trimming". Certain embodiments are able to accomplish such effects because the size of the razor blades and/or razor head are very small in comparison to conventional razor blades and because the handle allows for greater control of the razor blade. In some embodiments, the blade and/or the combined width of the blade and head portion of the razor is 1 inch, ½ inch, ⅜ inch, ¼ inch, ⅛ inch or any size or range of sizes in between any of these sizes. Furthermore, in certain embodiments, each of the different size blade(s) or head(s) can be used as interchangeable cartridges on the same razor handle, and can have single or multiple cutting edges.

In certain embodiments, the razor is integrally molded, in plastic for example, to provide a number of different blade width shaving heads in a disposable form. The various width shaving heads can be interchangeably mounted on the same handle in some embodiments allowing maximum flexibility in the usage of a shaver. For instance, for general purpose shaving a larger shaving head can be used such that an area of hair can be removed faster. However, where an area is difficult to shave due to the space availability of the surface, or where greater detail is required, a smaller shaving head can be used to carefully remove the unwanted hair while leaving undisturbed the surrounding hair or skin.

Conventional hand-held razors exist in disposable and replaceable head, or standard, types. For example, standard and disposable razors are marketed by Gillette, Schick and other such companies. These companies typically sell these two types of razors. The disposable razor includes a handle and angled head having a fixed blade or twin fixed blades as a single, integrally molded device. The disposable razor may be thrown away when the blade has become too dull for effective shaving. The standard razor includes a handle and head that includes some sort of retention mechanism for holding replaceable blade cartridges.

While both types of razors are extremely popular, the razor blades are fairly wide and are typically only effective for shaving large surfaces such as facial hair or leg hair, for example. Embodiments of the present invention provide a significant improvement in that a variety of narrower width blades can be provided to facilitate use of a razor for styling and grooming of smaller or more awkward areas of the body. Additionally, other embodiments facilitate the use of different sized blades such that large amounts of hair can be removed as in common disposable and standard razors and also very detailed shaving can be performed with the same handle by switching the shaving head.

Figure 2:
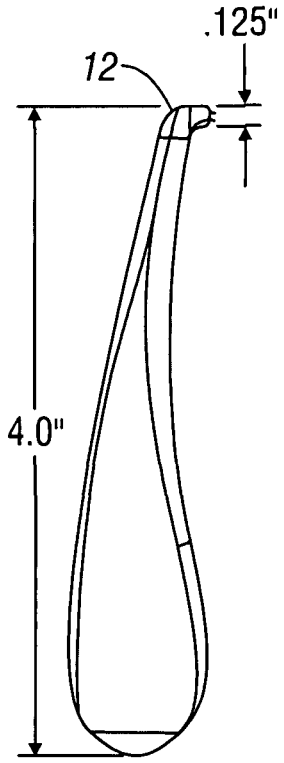
FIG. 2 is a side perspective view of the razor of FIG. 1.

FIG. 1 shows a front view of an embodiment of the invention having a handle 10 and blade attachment portion 20. As shown in the side view of an embodiment illustrated by FIG. 2, the blade attachment portion 20 is part of an angular head portion 12 of the handle 10. Preferably, the handle and blade attachment portion are formed of a lightweight material in a well-known manner, for example, by using injection-molded plastic. However, any suitable material and fabrication method can be used to produce the angular head portion 12 and the blade attachment portion 20. In some embodiments, the handle is hollow and has an aesthetically and ergonomically pleasing shape. In certain other embodiments, the handle is solid or hollow and has a grip portion 11. The grip portion 11 of some embodiments is larger, at least in part, than the rest of the handle to allow greater control of the shaving head where precision is required. The ergonomic shape of certain embodiments of the handle include curved portions such as those illustrated in FIG. 1 and FIG. 2. FIG. 1 illustrates an embodiment employing multiple curved portions forming a wavy effect allowing for a better grip on the handle and leading to better and more accurate control of the shaving head. While the embodiment illustrated in FIG. 2 includes a larger thickness in the bottom section of the grip portion 11, this is only an example and the handle can be substantially the same thickness along its length, or it can vary as well.

Still referring to the embodiment illustrated in FIG. 1, the handle 10 may be described as having a lower curved portion and an upper curved portion with a waist portion between the lower and upper curved portions. The waist portion and the two curved portions provide an effective shape for manipulation by the user's hand. This shape, and other shapes that provide improved manipulation, allows a user to more accurately control the shaving head of the razor. This allows shaving with the care and precision required to shave certain hair-growing areas of the body, or to shave designs into a person's hair with increased detail. The ergonomic shape of the handle 10 combined with the reduced width of the shaving head 20 allow for increased detail in shaving. A design ratio of the width of the curved portion of the handle 10 to the width of the head 20 of greater than one is preferred. Yet further preferred ratios are 1.33:1, 1.5:1 and the most preferred ratio is 2:1 or greater. Such ratios typically ensure that the head 20 is narrow enough to shave with the desired detail while the handle 10 is wide enough to allow a control of the head 20 sufficient to effectively utilize the improved detail.

Figure 3:
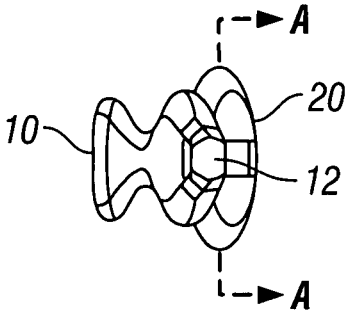
FIG. 3 is a top perspective view of the razor of FIG. 1.
Figure 4:
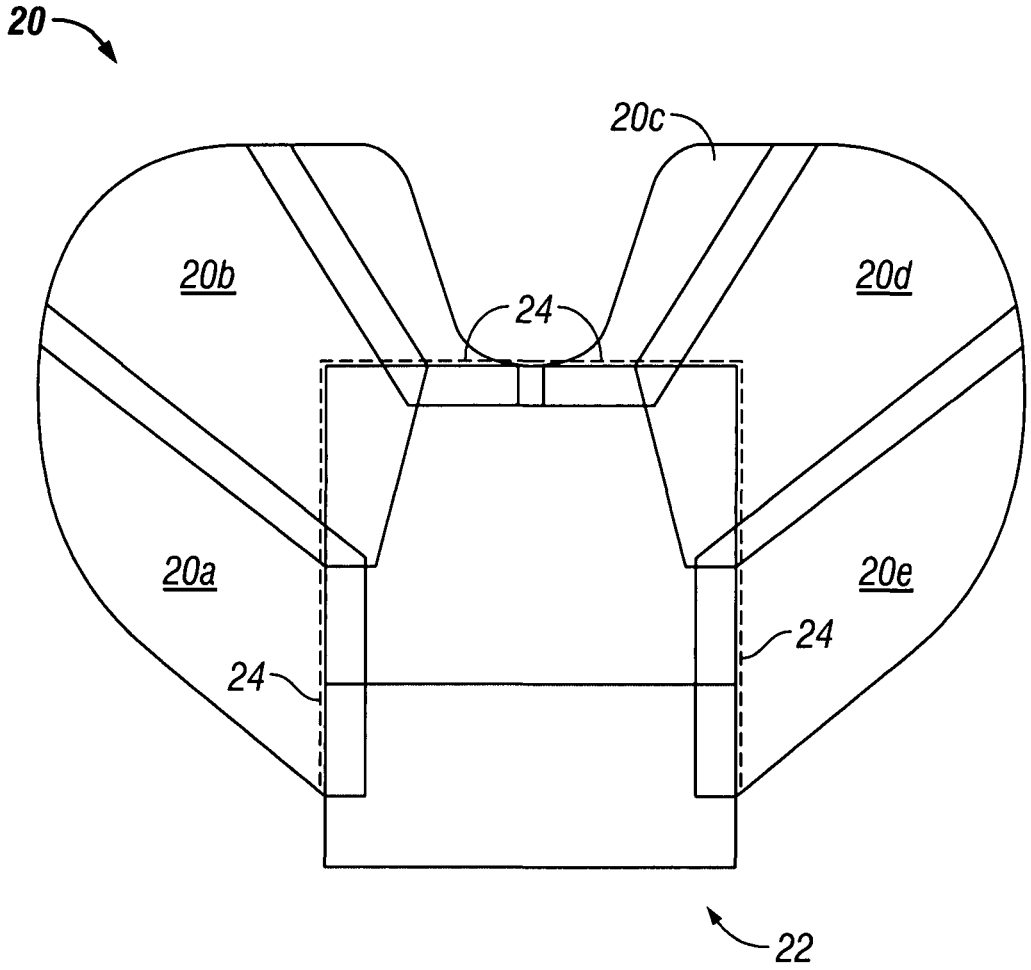
FIG. 4 is a top perspective view of a portion of the razor of FIG. 1 taken across section A-A of FIG. 2.

FIG. 3 illustrates how the blade attachment portion 20 is integrated with the handle 10. FIG. 4 provides additional detail regarding the inclusion of a razor blade 22 in the blade attachment portion 20. In certain embodiments, the blade attachment portion 20 includes five sections 20*a*-20*e* which are organized in a fan-like arrangement and then molded together. Thus, portions 20*a* and 20*e* overlap portions 20*b* and 20*d*, respectively. Likewise, the rear portion 20*c* also overlaps portions 20*b* and 20*d*. The inside lip of each portion includes a recess 24 (dashed line) to securely accommodate one or more blades. A machine inserts a steel blade portion 22 of the desired size into the recess. As noted above, the width of the steel razor blade be approximately one inch or less, and the dimensions of the blade attachment portion 20 will vary accordingly to accommodate a particular blade size. Although other blade sizes can be used. Once the blade is in place, the blade attachment portion is either snapped into a corresponding receptacle area on the handle, or fixed in place by heating/melting the pieces together.

Other embodiments of the blade mounting portion 20 are produced as a complete unit through injection molding or other typical manufacturing techniques. Yet other embodiments produce other portions that are then combined to form the head portion. Manufacturing techniques that are currently utilized to produce standard shaving cartridges are used in other embodiments, with the processes being slightly modified to produce the smaller blade sizes. These are only a few examples and any process can be used to manufacture the blade attachment portion for connection to the handle 10. It should be noted that two or more razor blades could be fit into the recess on the blade attachment portion 20 to provide additional cutting edges.

Figure 5:
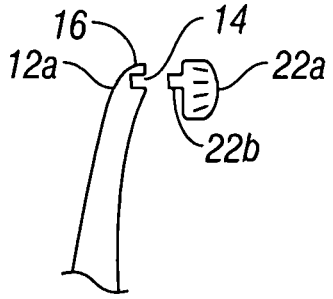
FIG. 5 is a side perspective view of an alternative embodiment of the inventive razor having a replaceable blade portion.

An alternative embodiment is shown in FIG. 5. In this embodiment, the angled head 12*a* includes a retention mechanism 14 which mates with a clip 22*b* on a replaceable blade cartridge 22*a* in a well known manner to secure the cartridge to the head 12*a*. Such a retention mechanism 14 and clip 22*b* can be of the sliding variety where the cartridge is slid onto the head 12*a* as in existing shavers, or it can snap into and out of place by resilience of the various components. The retention mechanism 14 includes a release 16, which is hand actuated to allow removal and replacement of the cartridge. Again, some embodiments allow the cartridge to slide off of the head 12*a* after its use is completed, while in other embodiments the cartridge snaps off by applying force to the back part of the cartridge. Yet other embodiments employ engaging and disengaging mechanisms that can alternately engage and disengage the cartridge with the head 12*a* by depressing or releasing an actuator on the back of the handle 10. Such mechanisms are well known in the art and any such mechanism can be used in these embodiments.

Figure 6B:
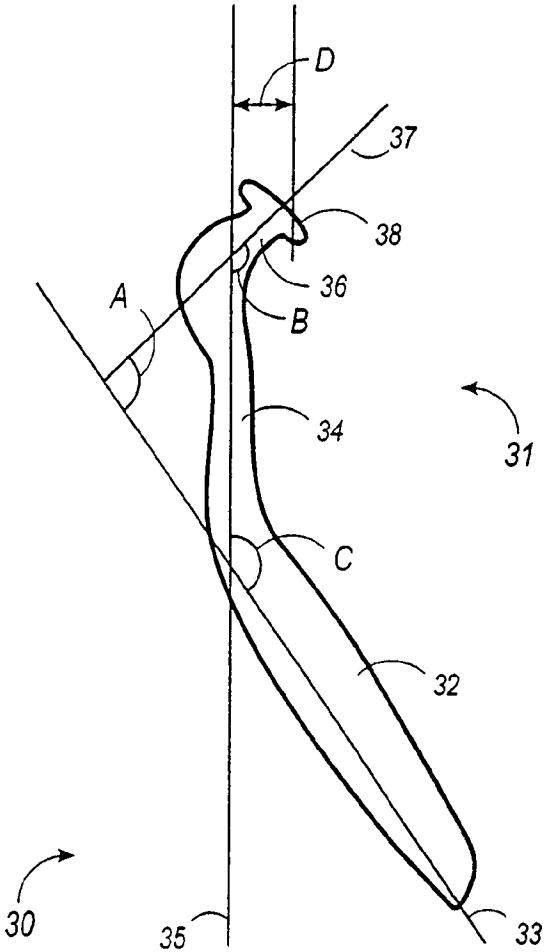
FIG. 6B is a side view of another embodiment of the razor of FIG. 1 showing a control angle of greater than ninety degrees.
Figure 6A:
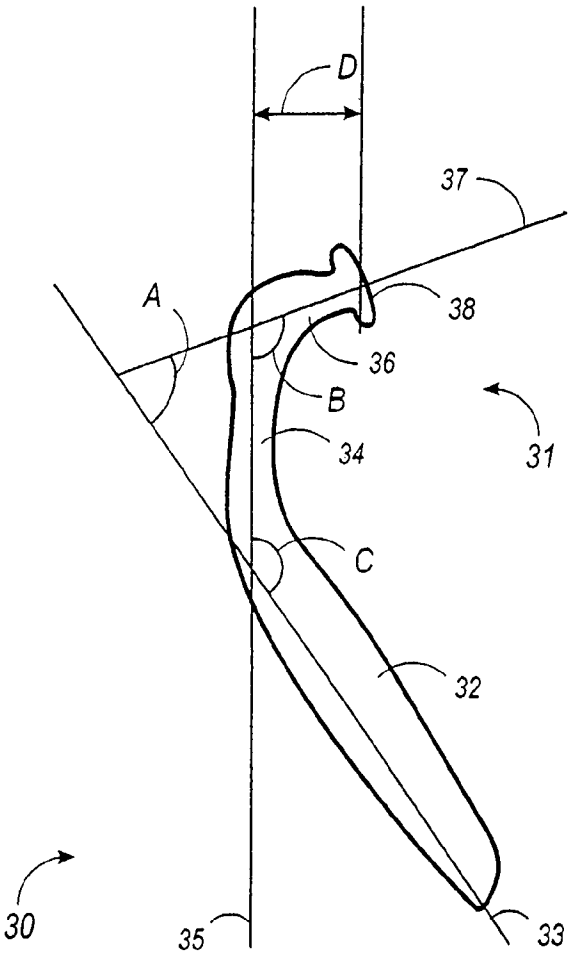
FIG. 6A is a side view of another embodiment of the razor of FIG. 1 showing a control angle of less than ninety degrees.

FIG. 6 is a side view of a razor 30 that is another embodiment of the handle 10 illustrated in FIG. 1. The razor 30 illustrated in FIG. 6 has a handle 31 made of three longitudinal portions, 32, 34, 36. The bottom longitudinal portion 32 represents a portion of the handle 31 that a user would grab to use the razor 30. The bottom longitudinal portion 32 extends generally along a first longitudinal axis 33. The middle longitudinal portion 34 represents a portion of the handle 31 that would complete the ergonomic design of the grip portion and allows a user to control the razor 30 with his or her fingers or finger tips to maximize the control over a shaving head 38 of the razor 30 during use of the razor 30. The middle longitudinal portion 34 extends generally along a second longitudinal axis 35. The top longitudinal portion 36 extends generally along a third longitudinal axis 37 and locates the shaving head 38 a distance "D" away from the rest of the razor 30. The distance D that the shaving head 38 is located away from the rest of the razor 30 provides multiple effects. As the distance D increases, the shaving head 38 can be maneuvered into tighter shaving locations. However, as the distance D continues to increase, the control over the shaving head can begin to decrease. Therefore, most embodiments of the razor 30 utilize an upper longitudinal portion 36 on a length ranging between ⅛ inch and one inch. Other embodiments will utilize a distance D of a length ranging between ¼ inch and ¾ inch. Yet other embodiments will utilize a distance D of less than ¾ inch, ⅝ inch, ½ inch or ⅜ inch. In some embodiments, the length of the upper longitudinal portion 36 is reduced due to a contour angle C between the first longitudinal axis 33 and the second longitudinal axis 35. As the contour angle C is increased the shaving head 38 is positioned closer to the surface to be shaved thereby reducing the length of the upper longitudinal portion 36 that is preferred for the same positioning of the lower longitudinal portion 32.

The first longitudinal axis 33 and the third longitudinal axis 37 form a control angle A that provides another design characteristic that can be controlled to maximize the control or effectiveness of the razor 30. In the embodiment illustrated in FIG. 6A, the control angle A is less than 90 degrees, however, this embodiment is only provided as an example and any angle between 0 and 180 degrees can be used. In some embodiments, the control angle A is less than 90 degrees while in other embodiments, the control angle A is greater than 90 degrees (see FIG. 6B). Additionally, the second longitudinal axis 35 and the third longitudinal axis 37 form an extension angle B that partially determines the angle at which the shaving head 38 is oriented with respect to the rest of the razor 30 when the razor 30 is utilized. The embodiment illustrated utilizes an extension angle B of greater than 90 degrees. This embodiment is just an example of an angle that may be used and any angle between 0 and 180 degrees can be utilized. The extension angle B can optimize the shaving angle the shaving head 38 makes with the skin surface to be shaved when the razor 30 is used, and certain embodiments utilize an extension angle B that is greater than 90 degrees while other embodiments will utilize an extension angle of less than 90 degrees.

Furthermore, the shaving head 38 is mounted to the upper longitudinal portion 36 at an angle that is appropriate for the application of the razor. In some embodiments, the shaving head 38 is mounted at a right angle while in other embodiments it is mounted at an angle where the bottom of the shaving head 38 is closer to the handle 31 of the razor 30, while in yet other embodiments, the shaving head 38 is mounted such that the bottom of the shaving head 38 is directed away from the handle 31 of the razor 30. In some embodiments, the shaving head 38 is mounted via a pivoting joint (not shown) such that the angle of the shaving head 38 can vary with respect to the rest of the razor 30 during shaving allowing its use in various applications. Any pivot joint capable of rotatably connecting the shaving head 38 to the upper longitudinal portion 36 can be used. The interaction of the length of the upper longitudinal portion 36 with the positioning of the lower longitudinal portion 32 and the contour angle C can be combined with the effects of the control angle A and the extension angle B to maximize the control over the shaving head 38 by the user. This allows the razor 30 to be used in areas where a high degree of precision is required.

By combining the extremely small shaving head 38 of some embodiments with the maximized precision control allowed by the handle 31, a razor 30 can now be manufactured that can be used to shave hair from areas not previously possible. While previous razors may have been somewhat smaller than other previous razors, none of those examples could are used for shaving hair as embodiments described herein allow. In some embodiments an upper longitudinal portion of a length of ¼ inch or larger is used in conjunction with a shaving head 38 that is ¼ inch or larger in width to allow a stylist to shave fine details into the scalp or beard of a person. Currently there is no razor available that is suitable for this application. Stylists previously broke straight razor blades to create shaving blades of the proper geometry to allow them to shave the styles requested by customers. This practice is unsafe for both the stylist and the customer. The razor 30 of the embodiments described herein allows safer shaving of such designs.

Certain embodiments utilize surface treatments to increase the grip of the handle 31 of the razor 30. Such treatments can include providing an uneven or knurled surface on the front, back or on one or both sides of the handle 31. Other embodiments attach a rubber surface or other material to all or portions of the handle 31 to increase the coefficient of friction of the handle 31, especially when wet. Yet other embodiments form the handle 31 of the razor of a material that itself has a high friction coefficient when held in the hand to increase the gripping capability by the user, even when wet.

Figure 7:
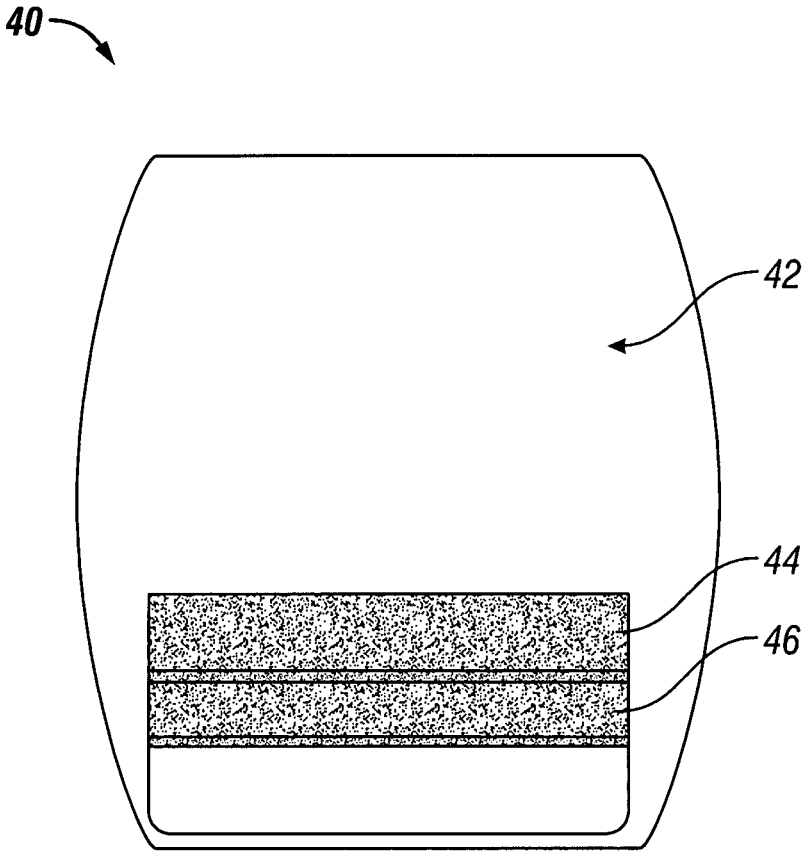
FIG. 7 is a front view of the shaving head of an embodiment of the razor of FIG. 1.

FIG. 7 is a front view of one embodiment of a shaving head 40. The shaving head 40 includes a glide surface 42 a first blade 44 and a second blade 46. Although two shaving blades are illustrated in this figure, this is only an example and more or less blades are used in various embodiments. In the embodiment illustrated in FIG. 7 the two blades are held in the shaving head 40 in a parallel alignment and are spaced apart from one another a sufficient distance to allow the hair removed by the first blade 44 to be cleared from the cutting edge as the shaving head moves along. Such alignments are common in the shaving industry and any suitable gap between the blades 44, 46 can be used. The shaving head 40 illustrated shows a glide surface 42 that is significant in comparison to the area of the two blades 44, 46. The ratio can be varied by changing the size of the glide area 42. Through adjustment of the size of the glide area 42 the overall size of the shaving head 40 can be increased or decreased depending on the application of the shaving head 40 while balancing the size reduction against the comfort and control provided by the glide area. Certain embodiments apply material to the glide area for soothing or improved gliding. Such material includes lotions, balms, ointments, medicated lotions and any other such materials.

Unexpected results have been obtained by the use of the razor having a generally reduced sized shaving head 38 in combination with an ergonomically designed handle. In embodiments described herein, varying the angle of the shaving head with respect to the handle can impact the comfort and ease of shaving various hair-growing locations. Varying angles of portions of the handle of the razor can also affect the ease of such shaving. In some embodiment, it has been found that combining a handle having relatively large width portions with a shaving head of very small width greatly improves the ability to shave in an accurate and detailed manner.

As is illustrated in FIG. 1, the handle portion 10 of some embodiments can be formed of at least two longitudinal portions attached end to end where the bottom longitudinal portion is formed of a first curvature and the second longitudinal portion is formed of a second curved shape. When lined up end to end, the curved shapes of these two longitudinal portions form a waist portion between the wide lower portion and the wide upper portion. This waist portion between the two relatively wider curvatures forms an ergonomic shape that conforms well to the hand of the user during shaving. This conformity allows increased accuracy for the use of the razor. In embodiments utilizing very narrow heads for shaving tight places or during high-precision shaving, this ergonomic shape provides the control over the shaving head 20 that is necessary for such applications.

Figure 8:
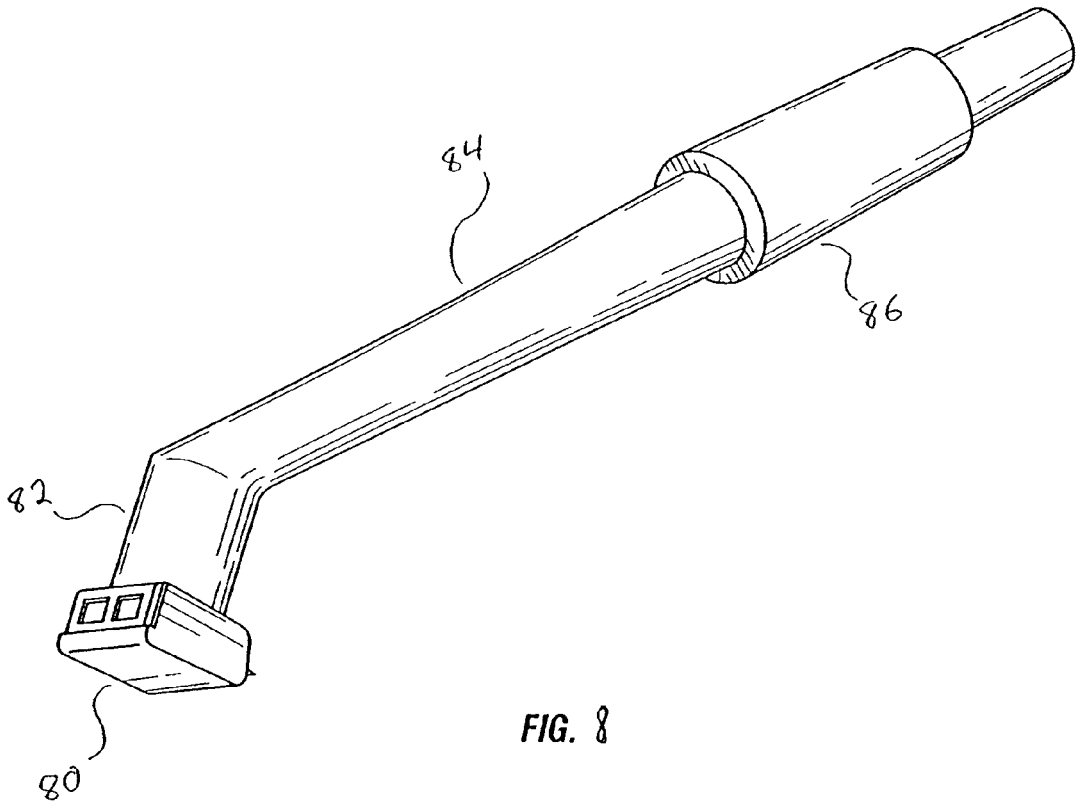
FIG. 8 is a perspective view of another embodiment of a razor of the present invention.

FIG. 8 is a perspective view of another embodiment of the razor having head portion 80 attached to an upper longitudinal portion 82 of the handle which is attached to a lower longitudinal portion 84 of the handle, and a grip enhancing element 86 surrounding a part of the lower longitudinal portion 84 of the handle.

Figure 9C:
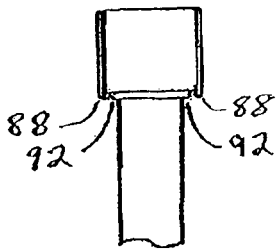
FIG. 9*c* is a close up of an embodiment of the upper portion of the razor.
Figure 9A:
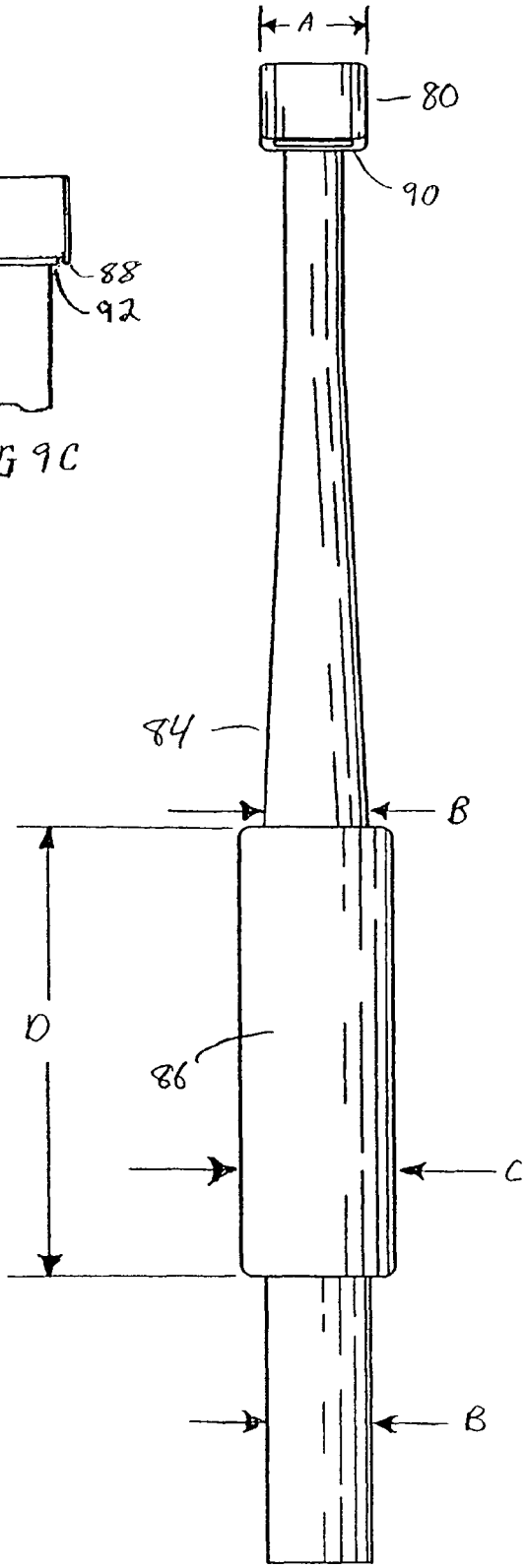
FIG. 9*a* is a front elevational view and FIG. 9*b* is rear elevational view of the razor of FIG. 8.
Figure 9B:
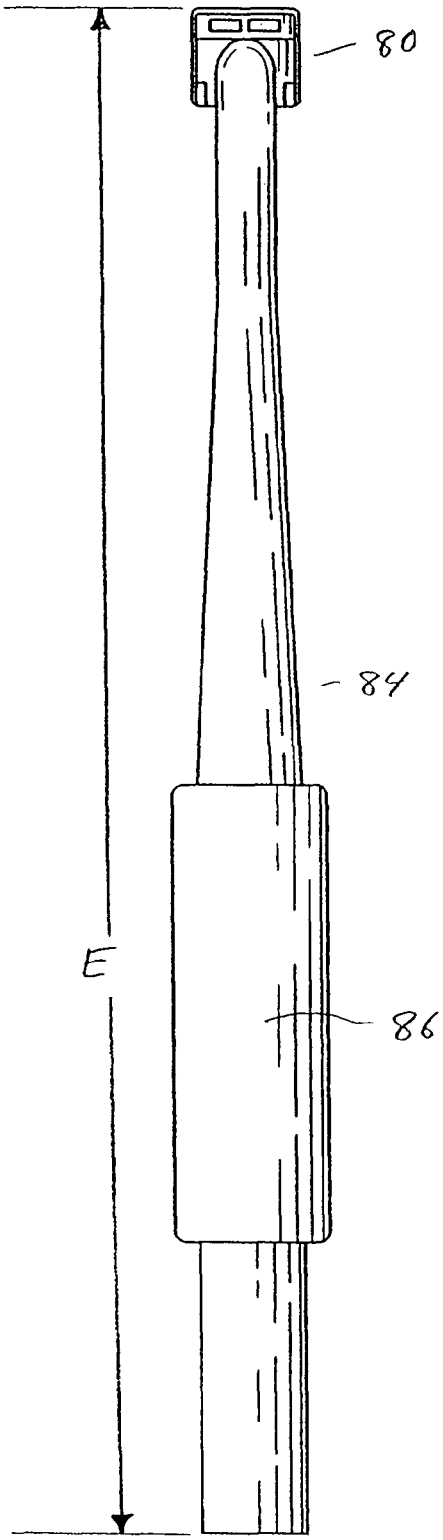

FIG. 9*a* is a front elevational view, and FIG. 9*b* is a rear elevational view, of the razor of FIG. 8. The head portion 80 preferably has a width A of about ¼ inch, although it can be about ⅜ inch, or about ⅛ inch or any size or range of sizes in between any of these sizes. As shown in FIGS. 9*a* and 9*b*, the blade 90 located in the head portion 80 of the razor has a cutting edge that is substantially perpendicular to the longitudinal axis of the handle 84. The cutting edge of the blade 90 extends beyond the head portion to expose only a small portion of the blade, preferably about 0.02 inch. In a preferred embodiment, the blade extends beyond the razor head such that no portion of said razor, i.e. the razor head, or any guards, combs, etc., extends beyond the cutting edge of said blade, such that the cutting edge of said blade is unobstructed by any portion of said razor. By extending the blade only slightly beyond the head portion, Applicant has found that guards or other protective elements are unnecessary, and at the same time the unobstructed blade can shave the unwanted hair close to the skin without leaving any stubble by cutting the hair close to the root. In some embodiments, the head portion 80 is slightly wider, e.g. 1/32 inch or less, than the width of the blade 90. Optionally, as shown in FIG. 9*c*, the edges of the head portion are extended on each end of the cutting edge of the blade to form corner guards 88 so that the corners 92 of the cutting edge of the blade are not exposed, although a gap between the corner guards and the corners of the blade is permissible. Preferably, these corner guards extend so that their bottom edges are even with the cutting edge of the blade (e.g. about 0.02 inch). This reduces the risk of, the corners of the cutting edge of the blade cutting the skin, while permitting the cutting edge of the blade to shave unwanted hair close to the root.

The lower longitudinal portion of the handle 84 preferably has a maximum diameter or width B that is about ¼ inch, although other diameters are possible, such as about ⅜ inch, or about ⅛ inch, or any size or range of sizes in between any of these sizes. The lower longitudinal portion of the handle has a grip enhancing element 86 disposed around it which preferably has an outer diameter or maximum width C of about 0.33 inch, although other diameters or widths are possible, such as about ⅜ inch, ¼ inch, or about ⅛ inch, or any size or range of sizes in between any of these sizes. The grip enhancing element 86 covers only part of the lower longitudinal portion 84 of the handle, and has a length dimension D preferably of about 1 inch, although other lengths are contemplated, such as about 1.5, 1.25, 0.9, 0.8, 0.7, 0.6, 0.5, or any size or range of sizes in between any of these sizes. The grip enhancing element is preferably made from a deformable material such as a thermoplastic elastomer, and can optionally have an irregular surface to enhance gripping of the handle. The razor preferably has an overall length E of about 3.4 inches, although other lengths are contemplated, such as about 3.75, 3.5, 3.25, 3.0, 2.75, 2.5, or 2.25, or any size or range of sizes in between any of these sizes.

Figure 10:
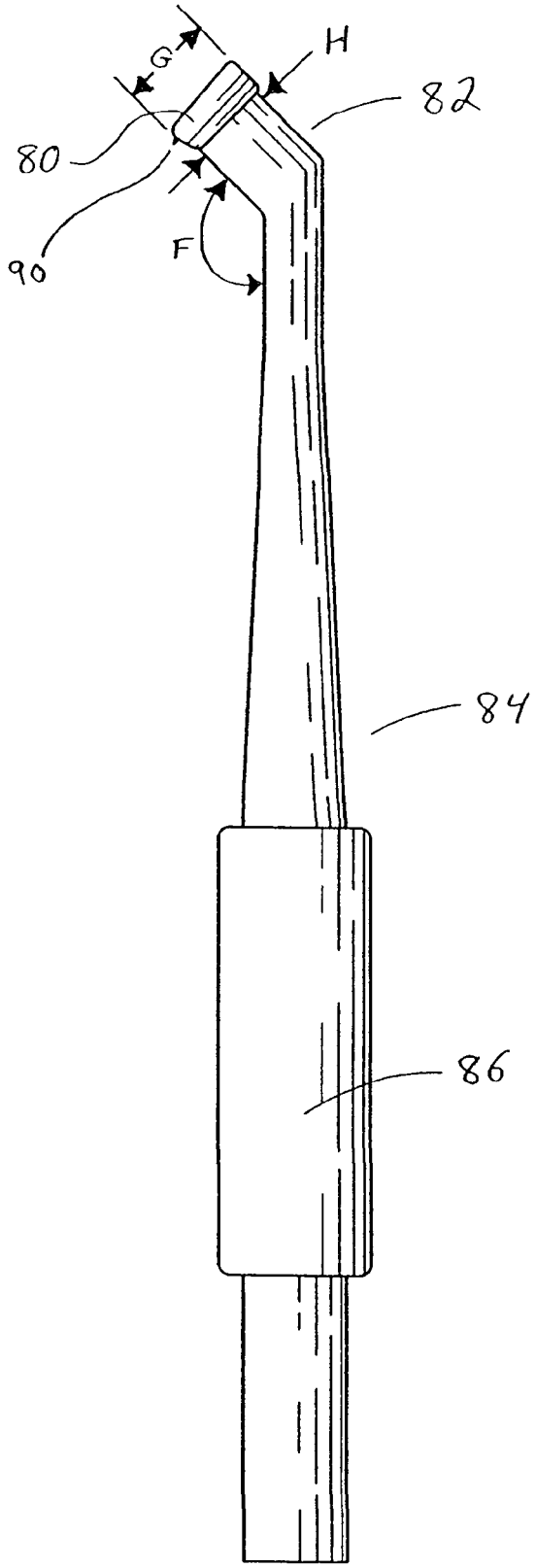
FIG. 10 is a left side elevational view of the razor of FIGS. 8 and 9.

FIG. 10 is a side elevational view of the razor of FIGS. 8 and 9, having a razor head 80 containing a blade 90, an upper longitudinal portion 84 and lower longitudinal portion 84 of the handle, and a grip enhancing element 86. The razor head 80 is attached to the upper longitudinal portion 82 of the handle, which is attached to the lower longitudinal portion 84 of the handle at an angle. The angle F between the central axis of the upper longitudinal portion 82 and the central axis of the lower longitudinal portion 84 is preferably about 135°, although other angles are contemplated, such as about 155°, 150°, 145°, 140°, 130°, 125°, 120°, or 115°, or any angle or range of angles in between any of these values. The head portion 80 has a length dimension G that is preferably about ¼ inch, although it can be about ⅜ inch, or about ⅛ inch or any size or range of sizes in between any of these sizes. The upper longitudinal portion has a maximum diameter or width H that is preferably about 0.2 inch, although other diameters are possible, such as about 0.5, 0.4, 0.3, or 0.1 inch, or any size or range of sizes in between any of these sizes. In a preferred embodiment, the razor, with the exception of the blade 90 and grip enhancing element 86, is a single piece of molded plastic. The head portion 80 is molded to have an upper and lower half connected by one or more hinge elements. The blade is placed in the head portion and the upper half is folded over the blade so that the upper and lower halves together form the final head portion with the blade. Preferably, the two halves are permanently fastened together, for example by sonic welding, snap fit, or adhesive. In other embodiments, the entire razor is injection molded around the blade as a single piece, optionally with the exception of the grip enhancing element 86. Single piece construction has advantages over multi-piece constructions because of ease of construction and cost. In some embodiments, the head portion is made of an upper and lower halve, with the blade sandwiched between the two halves. The two halves are secured together, for example by welding, snap fit, or adhesive.

Applicant has discovered that it is advantageous to hold the handle between the fingertips such that the head of the razor is relatively close to the fingertips as compared to a standard razor, and the portion of the handle below the portion gripped between the fingers is short enough that it does not contact the palm of the hand. Therefore, it is preferable that the overall length E of the razor be less than about 3.75 inches, and the diameter or maximum width B of the lower longitudinal portion 84 and/or the diameter or maximum width of C of the gripping element 86 be less than about ⅜ inch as this allows the user to manipulate the razor by holding the handle in just the fingertips.

The lower longitudinal portion 84 is tapered at the end closest to the upper longitudinal portion. This taper, along with the overall dimensions and placement of elements such as the grip enhancing element 86, combined to provide an esthetically pleasing razor.

The razors of the various embodiments illustrated and described above allow a user to shave parts of the body where shaving was previously not performed. The advantageous shape of the handle allows a user much greater control of the shaving head providing the confidence to shave the locations that the smaller shaving head make available. Up until now, people who have shaved designs into the hair of the scalps, beards or sideburns of others, typically use currently available razor blades to do so. They break a straight razor blade by hand into smaller pieces that can then be used to shave with the precision required for the details that were created. The embodiments described herein provide an alternative to this dangerous practice that will allow the detail shaving necessary to create the desired styles while providing a level of safety not currently available in the methods previously employed.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A personal shaving razor for shaving unwanted hair from a body surface, comprising:

a handle portion; and a head portion attached to said handle portion, said head portion comprising a razor blade having two corner portions and a straight cutting edge portion that is connected to said two corner portions, said straight cutting edge portion disposed substantially perpendicular to a longitudinal axis of said handle and extending beyond all other parts of said head portion along said straight cutting edge portion by about 0.02 inch such that no part of said head portion extends beyond said straight cutting edge portion of the blade along said straight cutting edge portion, wherein said head portion and blade are less than or equal to ¼ inch wide.

2. The razor of claim 1, wherein said handle portion has an upper longitudinal portion and a lower longitudinal portion;

wherein said lower longitudinal portion has a longitudinal axis and said upper longitudinal portion has a longitudinal axis and said longitudinal axes of said upper and lower longitudinal portions form an angle that is about 135 degrees;

wherein said head portion is attached to an end of said upper longitudinal portion; and wherein said cutting edge portion of said razor blade is substantially perpendicular to the longitudinal axis of said upper longitudinal portion of said handle.

3. The razor of claim 2, further comprising a grip enhancing element on a portion of the lower longitudinal portion of the handle;

wherein said grip enhancing element is made from a deformable material;

wherein said grip enhancing element is located on said lower longitudinal portion of the handle such that a segment of said lower longitudinal portion above and below said grip enhancing element does not have a grip enhancing element; and wherein said grip enhancing element has a maximum width less than or equal to about ⅜ inch.

4. The razor of claim 1, wherein said razor has an overall length of less than or equal to about 3.5 inches.

5. The razor of claim 4, wherein said lower longitudinal portion has a maximum width of less than or equal to about ⅜ inch.

6. The razor of claim 1, wherein the head portion and handle portion, with the exception of the blade, are a single piece of molded plastic.

7. The razor of claim 1, wherein said razor blade further comprises a first side edge and a second side edge, each of said first side edge and said second side edge connected to said straight cutting edge portion of the blade by one of the two corner portions of the blade, and wherein said head portion further comprises a corner guard disposed along each of said first side edge and said second side edge.

8. The razor of claim 1, wherein said head portion and blade are about ⅛ to about ⅜ inch in length.

9. The razor of claim 1, wherein the razor comprises no more than one head portion.

10. The razor of claim 1, wherein the head portion comprises no more than one blade.

11. A personal shaving razor for shaving unwanted hair from a body surface, comprising a handle portion having an upper longitudinal portion and a lower longitudinal portion, wherein said lower longitudinal portion has a longitudinal axis and said upper longitudinal portion has a longitudinal axis and said longitudinal axes of said upper and lower longitudinal portions form an angle that is about 135 degrees, and said handle portion has a maximum width of less than or equal to about ⅜ inch ; a head portion attached to an end of said upper longitudinal portion of said handle such that said head portion is substantially normal to said longitudinal axis of said upper longitudinal portion of said handle, said head portion comprising a razor blade having two corner portions and a straight cutting edge portion that is connected to said two corner portions, said straight cutting edge portion disposed substantially perpendicular to a longitudinal axis of said handle and extending beyond all other parts of said head portion along said straight cutting edge portion by about 0.02 inch such that no part of said head portion extends beyond said straight cutting edge portion of the blade along said straight cutting edge portion; wherein said head portion and blade are less than or equal to about ¼ inch wide; and wherein said razor has an overall length of less than or equal to about 3.5 inch.

12. The razor of claim 11, wherein said head portion and blade are about ⅛ to about ⅜ inch in length.

13. The razor of claim 11, wherein the razor comprises no more than one head portion.

14. The razor of claim 11, wherein the head portion comprises no more than one blade.

* * * * *